US012480274B2

(12) United States Patent
Son

(10) Patent No.: US 12,480,274 B2
(45) Date of Patent: Nov. 25, 2025

(54) UNDERGROUND FACILITY AND METHOD OF CONSTRUCTING UNDERGROUND FACILITY

(71) Applicant: Young Jong Son, Gyeongsangbuk-do (KR)

(72) Inventor: Young Jong Son, Gyeongsangbuk-do (KR)

( * ) Notice: Subject to any disclaimer, the term of this patent is extended or adjusted under 35 U.S.C. 154(b) by 327 days.

(21) Appl. No.: 18/319,323

(22) Filed: May 17, 2023

(65) Prior Publication Data

US 2023/0374748 A1 Nov. 23, 2023

(30) Foreign Application Priority Data

May 23, 2022 (KR) ..... 10-2022-0063140

(51) Int. Cl.
*E02D 29/045* (2006.01)
*E02D 31/02* (2006.01)

(52) U.S. Cl.
CPC ..... *E02D 29/045* (2013.01); *E02D 31/02* (2013.01); *E02D 2200/12* (2013.01); *E02D 2300/0032* (2013.01)

(58) Field of Classification Search
CPC ..... E02D 29/045; E02D 3/02; B66B 5/26; B66B 5/02
USPC ..... 52/742.1
See application file for complete search history.

(56) References Cited

U.S. PATENT DOCUMENTS 4,078,346 A * 3/1978 Mann ..... E04H 9/06 52/169.4
4,352,260 A * 10/1982 Pearcey ..... E04B 1/3211 D25/19
4,642,952 A * 2/1987 Prandin ..... E04H 9/12 109/1 S
4,955,166 A * 9/1990 Qualline ..... E04H 9/12 D25/36
5,775,043 A * 7/1998 Muroi ..... F24F 7/04 414/244
6,385,920 B1 * 5/2002 Chandler ..... E04H 9/12 52/169.7

(Continued)

FOREIGN PATENT DOCUMENTS

KR 20-0246947 Y1 10/2001
KR 10-2011-0133176 A 12/2011

(Continued)

*Primary Examiner* — Paola Agudelo
(74) *Attorney, Agent, or Firm* — KORUS Patent, LLC; Seong Il Jeong

(57) ABSTRACT

Disclosed herein are a construction structure and method for an underground facility. The construction structure for an underground facility includes: a facility body including a foundation constructed by pouring concrete, and a cover member extending in the front-back direction and having both ends configured to extend downward and be fixed to the top surface of the foundation to form a tunnel-shaped space therebelow; and a soil cover layer formed to cover the facility body with soil. The construction method for an underground facility includes: forming a pit in the ground; constructing a foundation on the bottom surface of the pit; constructing a cover member to cover the top of the foundation; and constructing a soil cover layer by covering the pit with soil to cover the cover member.

4 Claims, 8 Drawing Sheets

(56) References Cited

U.S. PATENT DOCUMENTS

| | | | | |
|---|---|---|---|---|
| 2002/0064426 | A1* | 5/2002 | Mccavour | E01F 5/005 405/126 |
| 2007/0261341 | A1* | 11/2007 | Lockwood | E21D 11/08 52/380 |
| 2009/0064604 | A1* | 3/2009 | Yamaguchi | E02D 29/045 52/169.6 |
| 2009/0191003 | A1* | 7/2009 | Kruse | E04H 7/20 405/229 |
| 2018/0030684 | A1* | 2/2018 | Heierli | E02D 29/045 |
| 2020/0088425 | A1* | 3/2020 | Teoh | F24F 7/025 |
| 2022/0081926 | A1* | 3/2022 | Yano | E05F 15/67 |
| 2022/0195747 | A1* | 6/2022 | Yano | E04H 9/08 |
| 2023/0052761 | A1* | 2/2023 | Hubbard | F24F 13/222 |

FOREIGN PATENT DOCUMENTS

| | | | |
|---|---|---|---|
| KR | 10-1728282 | B1 | 5/2017 |
| KR | 10-1917238 | B1 | 11/2018 |
| KR | 10-1955319 | B1 | 3/2019 |
| KR | 10-2154666 | B1 | 9/2020 |

* cited by examiner

UNDERGROUND FACILITY AND METHOD OF CONSTRUCTING UNDERGROUND FACILITY

CROSS-REFERENCE TO RELATED APPLICATION

This application claims the benefit of Korean Patent Application No. 10-2022-0063140 filed on May 23, 2022, which is hereby incorporated by reference herein in its entirety.

BACKGROUND

1. Technical Field

The present invention relates to an underground facility having a new structure that can easily maintain temperature and reduce heating and cooling costs.

2. Description of the Related Art

In general, vinyl houses used in farmhouses are configured by fixing vinyl sheets to cover the peripheries of frames.

Such vinyl houses store heat from sunlight and thus maintain the temperature of the interior spaces thereof higher than that of the surroundings, thereby providing the advantage of reducing heating costs.

However, such vinyl houses have problems in that a change in temperature is severe between the day and night because insulation performance is poor and continuous maintenance and repair are required because the strength of the vinyl sheets is weak.

Therefore, there is a need for a new method capable of overcoming these problems.

RELATED ART LITERATURE

Patent Document: Korean Patent No. 10-2154666

SUMMARY

The present invention has been conceived to overcome the above-described problems, and an object of the present invention is to provide a construction structure and method for an underground facility having a new structure that can easily maintain temperature and reduce heating and cooling costs.

According to an aspect of the present invention, there is provided a construction structure for an underground facility, the construction structure including: a facility body including a foundation constructed by pouring concrete, and a cover member extending in the front-back direction and having both ends configured to extend downward and be fixed to the top surface of the foundation to form a tunnel-shaped space therebelow; and a soil cover layer formed to cover the facility body with soil.

The cover member may be constructed by bending a corrugated steel plate in an arc shape.

The facility body may be constructed in a valley formed between mountains; and the soil cover layer may be formed by covering the valley with soil.

The construction structure may further include: an intake pipe and an exhaust pipe extending from the cover member to a location above the soil cover layer; an air supply fan provided in the intake pipe, and configured to supply external air to the inside of the facility body; and a dehumidification means for removing moisture contained in the air sucked through the intake pipe; and the dehumidifying means includes: a cooling unit provided with an evaporator provided in the central portion of the intake pipe and a compressor and a condenser connected to the evaporator, and configured to evaporate a refrigerant, condensed by the compressor, in the evaporator so that moisture contained in air passing through the intake pipe is condensed by the evaporator and then removed; a water collection case provided under the evaporator, and configured to collect moisture that is condensed by the evaporator and falls downward; a water storage tank connected to the water collection case through a connection pipe, configured to store water collected in the water collection case, and provided with a drain pipe that extends out of the facility body; a water level sensor provided in the water storage tank; and a drain pump provided on the drain pipe, and configured to receive a signal from the water level sensor and discharge the water stored in the water storage tank to the outside when the water level inside the water storage tank rises above a preset water level.

The construction structure may further include: an elevator passage formed to extend from the cover member to a location above the soil cover layer; an elevator car fitted into the inside of the elevator passage to be selectively lifted and lowered; a lifting device provided in a machine room formed in then top portion of the elevator passage, connected to the elevator car, and configured to selectively lift and lower the elevator car; and a fall prevention means configured to, when an abnormality occurs in the elevator car, be operated and prevent the elevator car from falling; the fall prevention means may include: rail members provided to extend vertically inside the elevator passage; a braking member coupled into a guide hole, formed in a circumferential surface of the elevator car, to be slidable inward or outward, and configured to, when pushed outward, be coupled with the rail members and generate frictional force; elastic members connected to the braking member, and configured to press the braking member inward; and a pressing mechanism provided on a bracket provided in the elevator car, and configured to press the braking member outward when the elevator car is lowered at an abnormal speed; the braking member may include: a slide block coupled into the guide hole to be slidable inward or outward, and provided with an outer surface inclined upward to an outside; and a friction member coupled to the outer surface of the slide block to be slidable in the vertical direction, and configured to come into close contact with the rail members and exert a braking force; and the pressing mechanism may include: a cam wheel coupled to the bracket to be rotatable in the vertical direction, and having a cam formed on a circumferential surface thereof; an extension bar extending inward from the circumferential surface of the cam wheel, and having a weight at the inner end thereof; a torsion spring provided on the cam wheel, and configured to elastically press the cam wheel so that the extension bar is rotated upward; and a ratchet rotatably coupled to the bracket, and configured to, when the cam wheel is rotated such that the extension bar is rotated upward, be caught on the inner end of the cam and perform fixation in order to prevent the cam wheel from being rotated in the opposite direction.

According to another aspect of the present invention, there is provided a construction method for an underground facility, the construction method including: forming a pit in the ground; constructing a foundation on the bottom surface of the pit; constructing a cover member to cover the top of the foundation; and constructing a soil cover layer by covering the pit with soil to cover the cover member.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

Hereinafter, the present invention will be described in detail with reference to the accompanying exemplary drawings.

Figure 1:
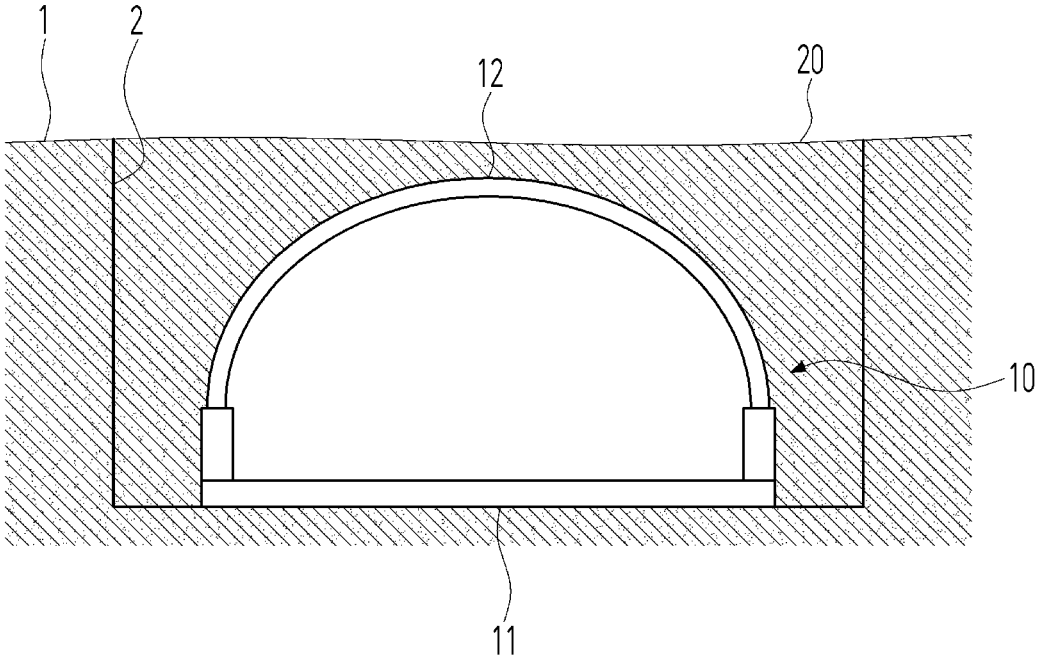
FIG. 1 is a front sectional view showing a construction structure for an underground facility according to the present invention.

FIG. 1 shows a construction structure for an underground facility according to the present invention. The construction structure for an underground facility includes: a facility body 10 configured to form a space therein and constructed on the bottom surface of a pit 2 formed in the ground 1; and a soil cover layer 20 formed by covering the pit 2 with soil in order to cover the facility body 10.

In more detail, the facility body 10 includes: a foundation 11 constructed by pouring concrete; and a cover member 12 extending in the front-back direction and having both ends configured to extend downward and be fixed to the top surface of the foundation 11 to form a tunnel-shaped space therebelow.

The cover member 12 is constructed by bending a corrugated steel plate in an arc shape, and both ends of the cover member 12 are fixed to the foundation 11.

A method of constructing the underground structure configured as described above will be described as follows.

First, the foundation 11 is constructed by forming the pit 2 of an appropriate depth in the ground 1, installing a formwork on the bottom surface of the pit 2, and pouring concrete into the formwork.

Then, the cover member 12 is fabricated by bending the corrugated plate, and both ends of the manufactured cover member 12 are fixed to the foundation 11, thereby constructing the facility body 10.

In addition, the soil cover layer 20 is formed by covering the pit 2 with soil to cover the facility body 10, thereby completing the construction of the underground facility.

Meanwhile, after the soil cover layer has been constructed, a warehouse or the like may be constructed on top of the soil cover layer 20.

According to the above-described construction structure for an underground facility, the facility body 10 is constructed to be buried in the ground 1, and thus the temperature can be kept constant, so that fuel or electricity can be saved according to temperature control, thereby providing the advantage of reducing heating and cooling costs.

In particular, the cover member 12 is constructed by bending a corrugated steel plate in an arc shape, so that there are advantages in that the cover member 12 can be manufactured at low cost and is light in weight and easy to transport and construct it.

Figure 2:
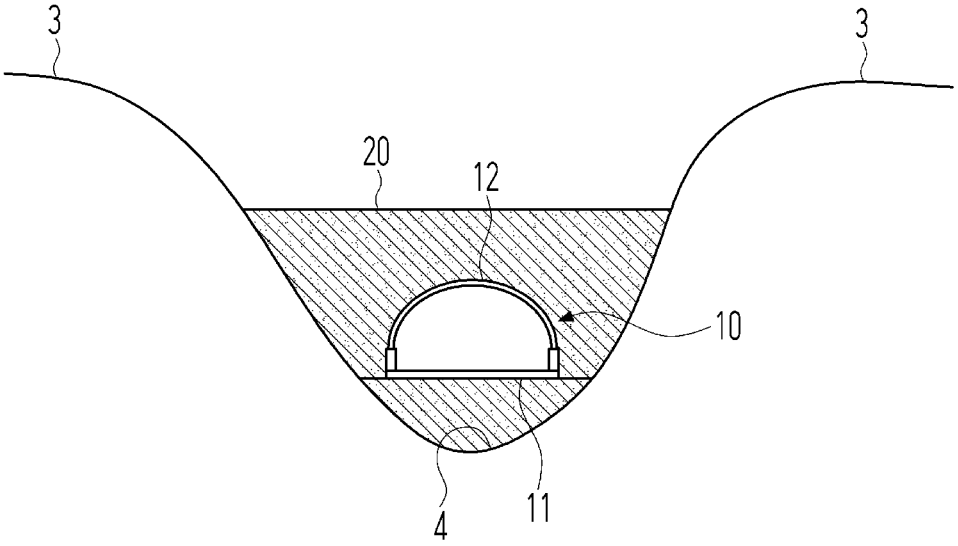
FIG. 2 is a front cross-sectional view showing a construction structure for an underground facility according to a second embodiment of the present invention.

FIG. 2 shows a second embodiment according to the present invention. A facility body 10 is constructed in a valley 4 formed between mountains 3, and a soil cover layer 20 is formed by covering the valley 4 with soil.

In this case, the cover member 12 of the facility body 10 may be manufactured using a corrugated plate, as in the first embodiment described above, or may be manufactured using reinforcing bars, corrugated plates, and concrete.

According to the underground facility construction structure configured as described above, the facility body 10 is constructed in the valley 4, so that there are advantages in that there is no need to dig a pit in the ground and the large-area facility body 10 can be installed.

FIGS. 3 to 10 show a third embodiment according to the present invention. This embodiment further includes an intake pipe 31 and an exhaust pipe 32 extending from the cover member 12 to a location above the soil cover layer 20, an air supply fan 33 provided in the intake pipe 31 and configured to supply external air to the inside of the facility body 10, and a dehumidification means 40 for removing moisture contained in the air sucked through the intake pipe 31.

Figure 3:
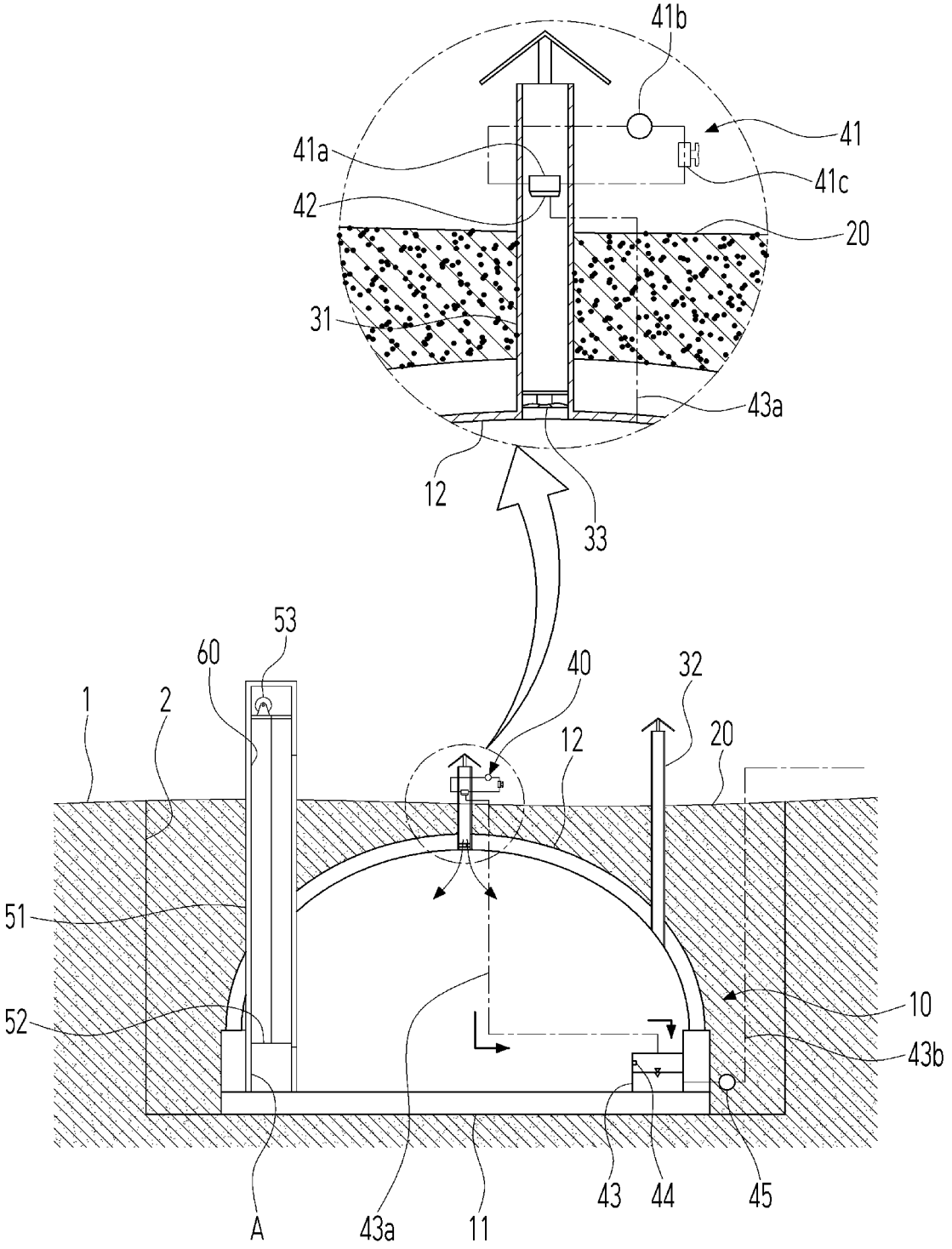
FIG. 3 is a front cross-sectional view showing a construction structure for an underground facility according to a third embodiment of the present invention.
Figure 4:
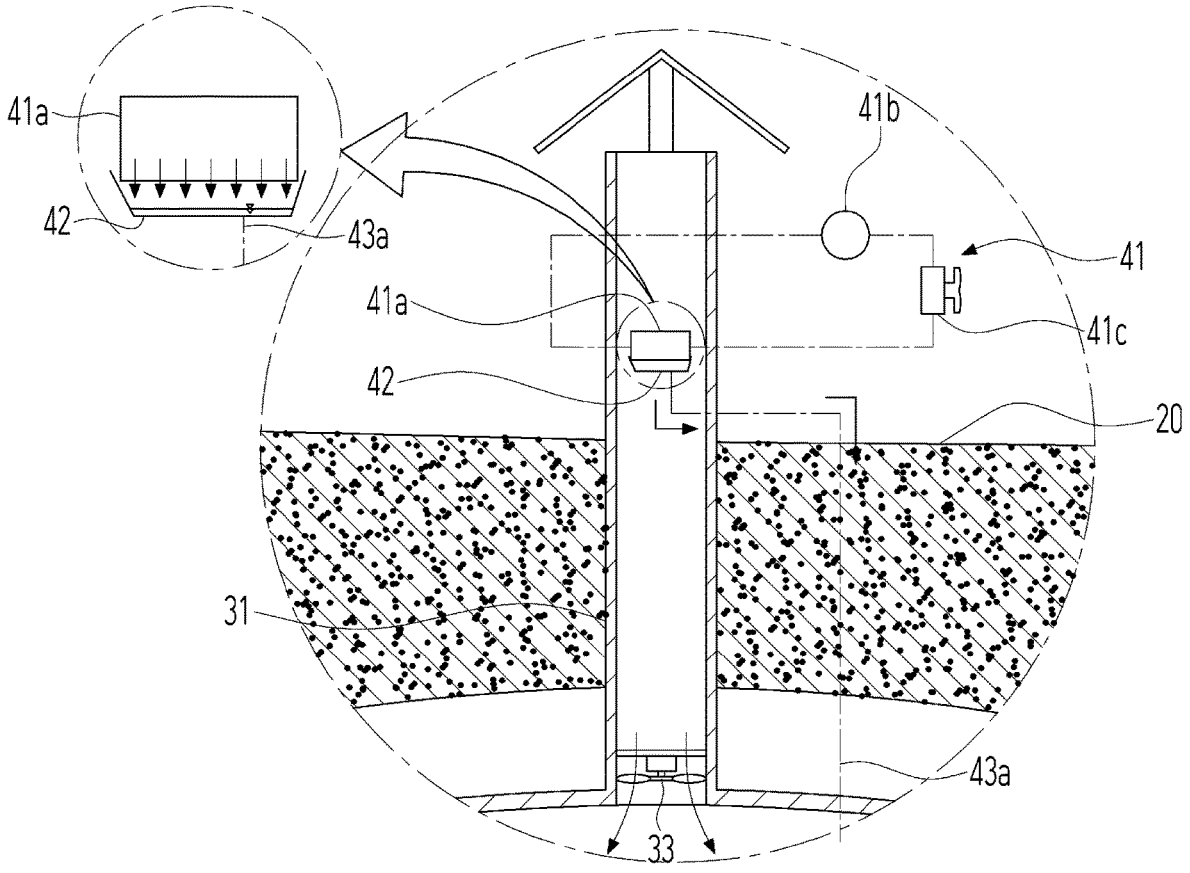
FIGS. 4 to 6 are enlarged front sectional views showing main parts of the construction structure for an underground facility according to the third embodiment of the present invention.

As shown in FIGS. 3 and 4, the dehumidifying means 40 includes: a cooling unit 41 provided with an evaporator 41*a* provided in the central portion of the intake pipe 31 and a compressor 41*b* and a condenser 41*c* connected to the evaporator 41*a*, and configured to evaporate a refrigerant, condensed by the compressor 41*b*, in the evaporator 41*a* so that the moisture contained in the air passing through the intake pipe 31 is condensed by the evaporator 41*a* and then removed; a water collection case 42 provided under the evaporator 41*a*, and configured to collect moisture that is condensed by the evaporator 41*a* and falls downward; a water storage tank 43 connected to the water collection case 42 through a connection pipe 43*a*, configured to store water collected in the water collection case 42, and provided with a drain pipe 43*b* that extends out of the facility body 10; a water level sensor 44 provided in the water storage tank 43; and a drain pump 45 provided on the drain pipe 43*b*, and configured to receive a signal from the water level sensor 44 and discharge the water stored in the water storage tank 43 to the outside when the water level inside the water storage tank 43 rises above a preset water level.

Accordingly, when the cooling unit 41 is operated while the air supply fan 33 is operated, the room-temperature air supplied through the intake pipe 31 is cooled while passing through the evaporator 41*a*, and the moisture contained in the air is condensed and collected in the evaporator 41*a*, falls downward, and is primarily stored in the water collection case 42.

Therefore, the humidity of the air supplied to the inside of the facility body 10 through the intake pipe 31 is reduced.

Meanwhile, On the other hand, the water stored in the water collection case 42 is supplied to the water storage tank 43 through the connection pipe 43*a* and is secondary stored therein.

Thus, a user may use the water stored in the water storage tank 43 as water available for use.

In this case, when the level of water stored in the water storage tank 43 rises above a preset water level, the water level sensor 44 detects it, and the drain pump 45 is operated in response to a signal from the water level sensor 44 and discharges the water stored in the water storage tank 43 to the outside through the drain pipe 43*b*, thereby preventing the overflow of the water, stored in the water storage tank 43, to the outside.

Meanwhile, when the air is supplied to the inside of the facility body 10 by the air supply fan 33, the air inside the facility body 10 is discharged to the outdoors through the exhaust pipe 32, so that ventilation is automatically performed.

Furthermore, as shown in FIGS. 5 to 10, the underground facility further includes: an elevator passage 51 formed to extend from the cover member 12 to a location above the soil cover layer 20; an elevator car 52 fitted into the inside of the elevator passage 51 to be selectively lifted and lowered; a lifting device 53 provided in a machine room formed in the top portion of the elevator passage 51, connected to the elevator car 52, and configured to selectively lift and lower the elevator car 52; and a fall prevention means A configured to, when an abnormality occurs in the elevator car 52, be operated and prevent the elevator car 52 from falling.

Entrances are formed in the upper and lower end portions of the elevator passage 51, and guide rails extending in the vertical directions are provided therein.

The elevator car 52 is configured in the form of a box to allow a vehicle to enter the inside of the elevator car 52 and to load cargo therein, and is coupled to the guide rails to be able to move up and down.

The lifting device 53 uses a winch configured to wind or unwind a wire connected to the elevator car 52.

The fall prevention means A includes: rail members 60 provided to extend vertically inside the elevator passage 51; a braking member 70 coupled into a guide hole 52*a*, formed in the circumferential surface of the elevator car 52, to be slidable inward or outward, and configured to, when pushed outward, be coupled with the rail members 60 and generate frictional force; elastic members 80 connected to the braking member 70, and configured to press the braking member 70 inward; and a pressing mechanism 90 provided on a bracket 52*b* provided in the elevator car 52, and configured to press the braking member 70 outward when the elevator car 52 is lowered at an abnormal speed.

The rail members 60 are made of high-strength metal material.

The braking member 70 includes a slide block 71 coupled into the guide hole 52*a* to be slidable inward or outward and provided with an outer surface inclined upward to the outside, and a friction member 72 coupled to the outer surface of the slide block 71 to be slidable in the vertical direction and configured to come into close contact with the rail members 60 and exert a braking force.

Figure 7:
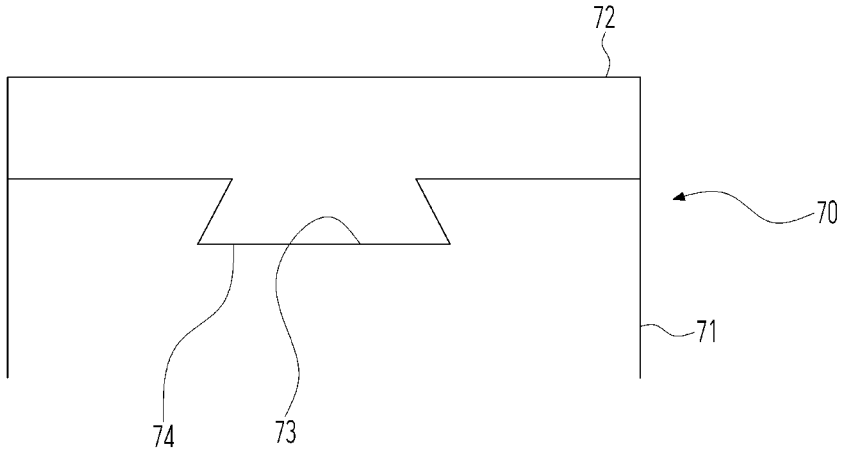
FIG. 7 is a plan view showing the braking member of the construction structure for an underground facility according to the third embodiment of the present invention.
Figure 8:
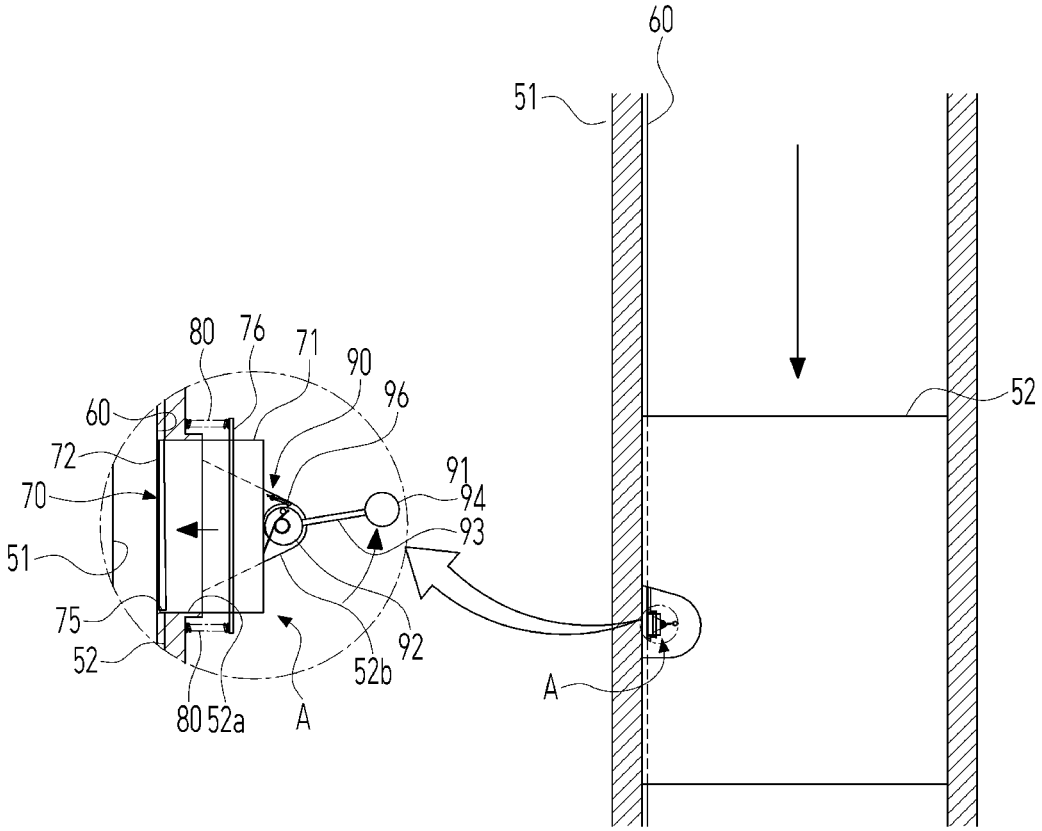
FIGS. 8 to 10 are reference views showing the operation of the construction structure for an underground facility according to the third embodiment of the present invention.

In this case, as shown in FIG. 7, a groove 73 extending in the vertical direction and a protrusion 74 slidably coupled into the groove 73 are provided on the adjacent surface of the slide block 71 and the friction member 72, respectively, and are configured to slide in the vertical direction along the outer surface of the slide block 71.

Meanwhile, the outer surface of the slide block 71 is configured to be inclined upward to the outside, so that it protrudes outward when the friction member 72 is raised.

In addition, a stop protrusion 75 configured to support the bottom end of the friction member 72 is formed at the bottom end of the outer surface of the slide block 71.

A compression coil spring that comes into close contact with a flange portion 76 formed on the circumferential surface of the slide block 71 and pushes the slide block 71 inward is used as the elastic member 80.

Figure 5:
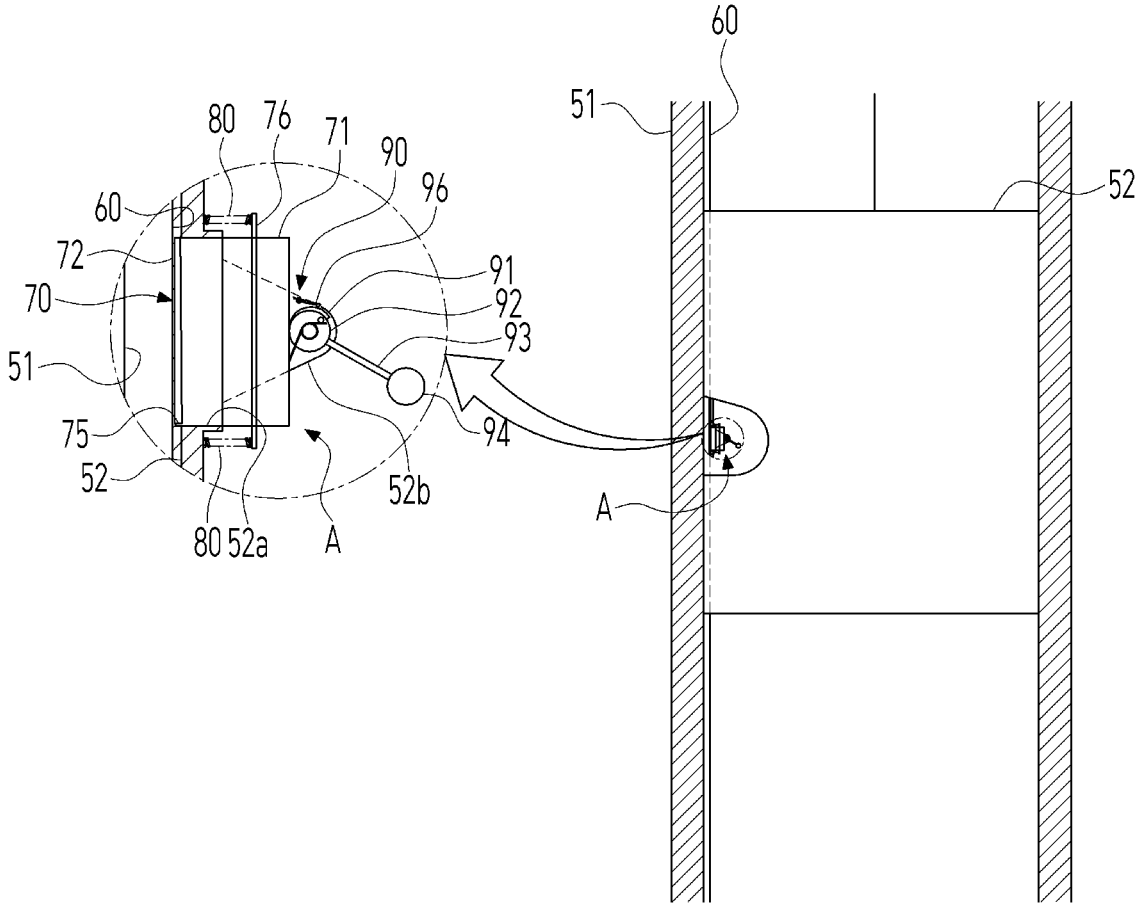
Figure 6:
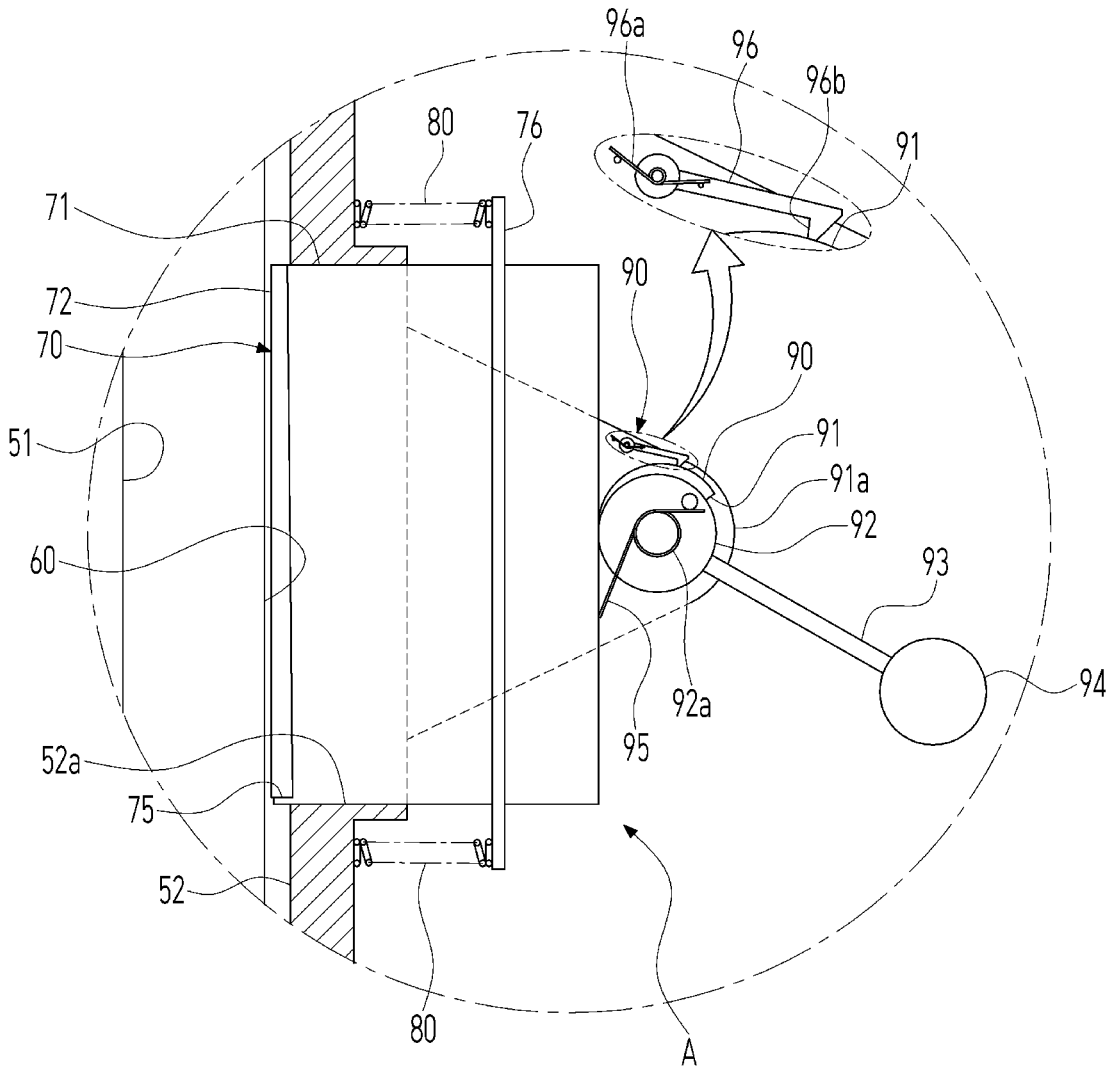

As shown in FIGS. 5 and 6, the pressing mechanism 90 includes: a cam wheel 92 coupled to the bracket 52*b* to be rotatable in the vertical direction, and having a cam 91 formed on the circumferential surface thereof; an extension bar 93 extending inward from the circumferential surface of the cam wheel 92, and having a weight 94 at the inner end thereof; a torsion spring 95 provided on the cam wheel 92, and configured to elastically press the cam wheel 92 so that the extension bar 93 is rotated upward; and a ratchet 96 rotatably coupled to the bracket 52*b*, and configured to, when the cam wheel 92 is rotated such that the extension bar 93 is rotated upward, be caught on the inner end of the cam 91 and perform fixation in order to prevent the cam wheel 92 from being rotated in the opposite direction.

The cam wheel 92 is rotatably coupled to a rotating shaft 92*a* coupled to the bracket 52*b* in order to extend laterally.

The cam 91 is formed to protrude outward when the upper end of the cam wheel 92 is rotated outward (when the cam wheel 92 is rotated counterclockwise in the case of the drawing), and a locking protrusion 91*a* is formed at the right end thereof.

The torsion spring 95 is coupled to the outside of the rotating shaft 92*a*, and both ends thereof are configured to come into close contact with the cam wheel 92 and the elevator car 52 and rotate the cam wheel 92 counterclockwise.

The ratchet 96 is formed in a bar shape extending inward and outward. The outer end of the ratchet 96 is rotatably coupled to the bracket 52*b*, and a locking portion 96*b* caught on the locking protrusion 91*a* protrudes downward at the inner end of the ratchet 96.

In this case, the ratchet 96 is pressed downward by the spring 96*a*.

The operation of the fall prevention means A configured as described above will be described as follows.

First, when the elevator car 52 is raised or normally lowered slowly by the lifting device 53, the cam wheel 92 is maintained in a state of being rotated clockwise by the weight of the weight 94, and the cam 91 is separated from the braking member 70, as shown in FIG. 6.

Accordingly, the braking member 70 is separated from the rail member 60, and thus the elevator car 52 is freely moved up and down.

Figure 9:
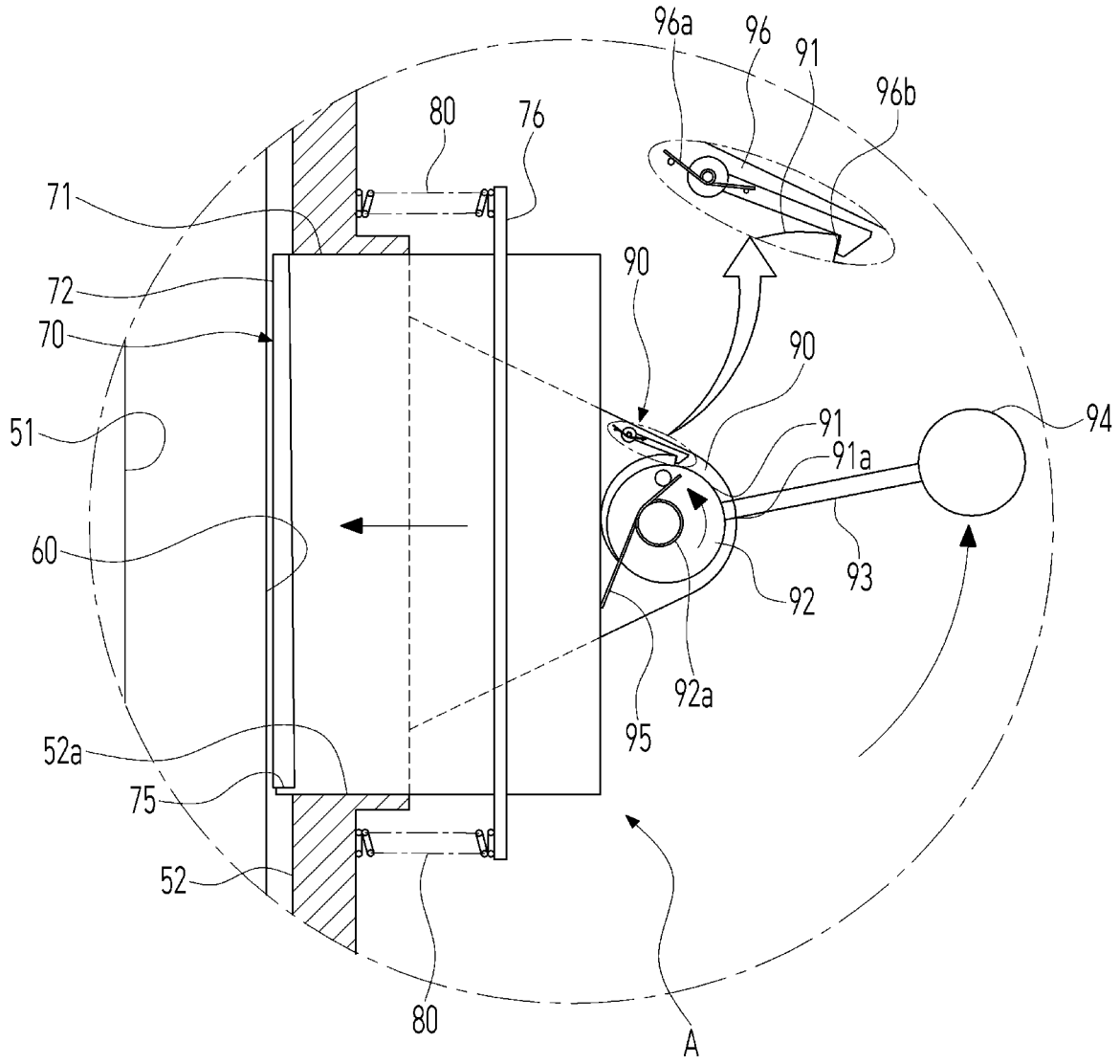

Conversely, when the wire of the lifting device 53 is cut and the elevator car 52 falls rapidly, the gravitational force acting on the weight 94 is weakened. Accordingly, as shown in FIG. 9, the cam wheel 92 is rotated in a direction in which the extension bar 93 and the weight 94 are raised (a counterclockwise direction in the case of the drawing) by the elasticity of the torsion spring 95.

Therefore, the circumferential surface of the cam 91 protrudes outward, i.e., toward the braking member 70 and pushes the braking member 70 outward, so that the braking member 70 comes into strong contact with the rail members 60 and exerts braking force.

In this case, as the cam 91 is rotated counterclockwise, the ratchet 96 is rotated downward, so that the locking portion 96*b* is coupled to the locking stop 91*a* of the cam 91 and the cam 91 is fixed such that it is not rotated in the opposite direction (the clockwise direction).

Figure 10:
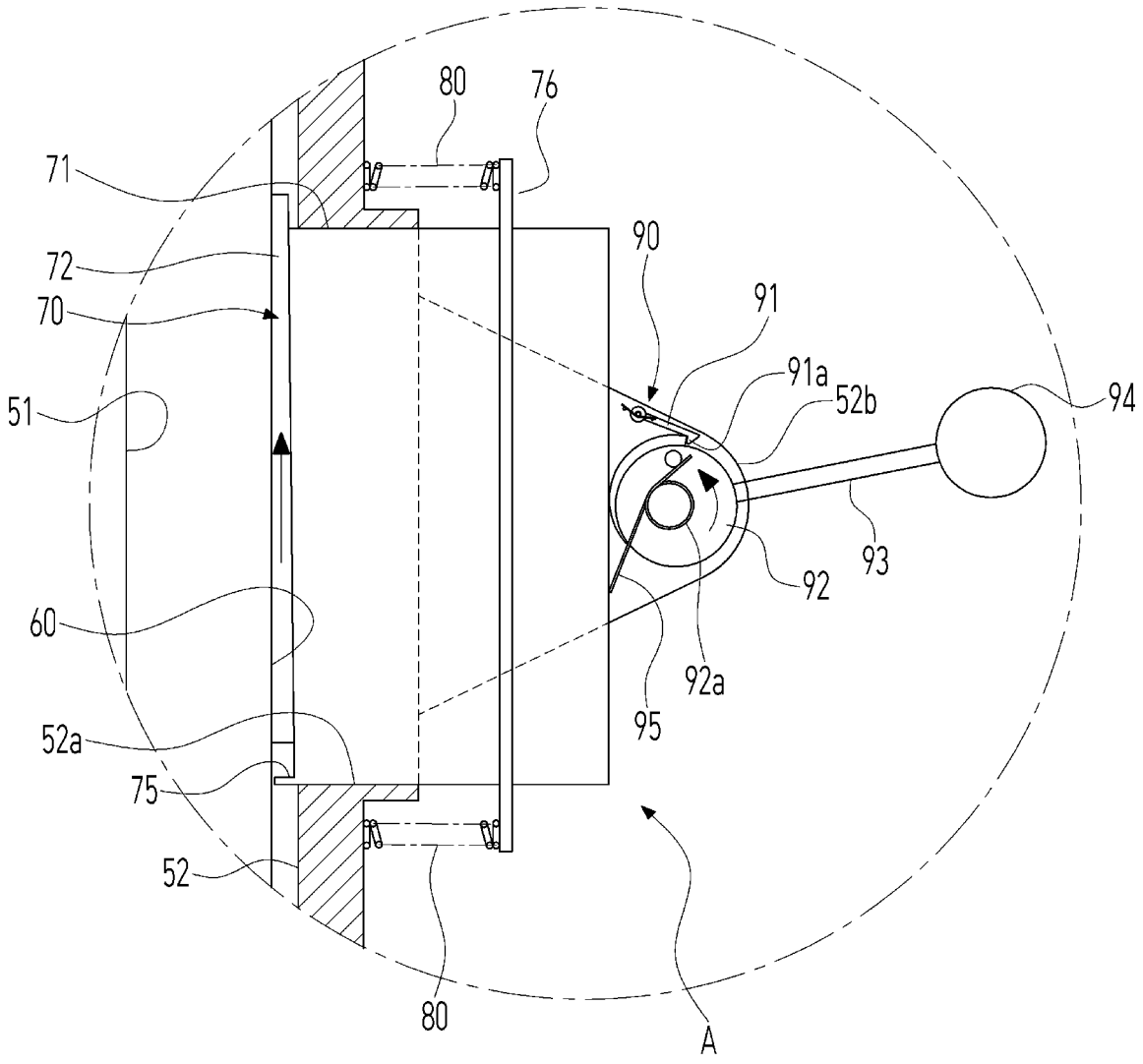

In addition, when the elevator car 52 is lowered in a state where the braking member 70 has come into close contact with the rail members 60, the friction member 72 in close contact with the rail member 60 is raised in a state where the slide block 71 is fixed, as shown in FIG. 10.

In this case, the outer surface of the slide block 71 is inclined upward to the outside. Accordingly, when the friction member 72 is raised, it protrudes outward along the slope of the outer surface of the slide block 71 and presses the rail members 60 more strongly. The frictional force between the rail member 60 and the braking member 70 is significantly increased, and the elevator car 52 is fixed such that it is not lowered.

According to the construction structure for an underground facility constructed in this manner, the moisture contained in the air is removed using the dehumidifying means while forcibly ventilating air using the intake pipe 31, the exhaust pipe 32, and the air supply fan 33, so that there is the advantage of preventing humidity inside the facility body 10 from increasing.

Moreover, the elevator passage 51 and the elevator car 52 are provided, and thus a vehicle can directly enter and exit the inside of the facility body 10 using the elevator car 52, so that there is an advantage in that it becomes easier to ship crops cultivated in the facility body 10.

According to the above-described construction structure for an underground facility, the facility body 10 is constructed to be buried in the ground 1, and thus the temperature can be kept constant, so that fuel or electricity can be saved according to temperature control, thereby providing the advantage of reducing heating and cooling costs. In particular, the cover member 12 is constructed by bending a corrugated steel plate in an arc shape, so that there are advantages in that the cover member 12 can be manufactured at low cost and is light in weight and easy to transport and construct it.

What is claimed is:

1. A construction structure for an underground facility, the construction structure comprising:

a facility body including a foundation constructed by pouring concrete, and a cover member extending in a front-back direction and having both ends configured to extend downward and be fixed to a top surface of the foundation to form a tunnel-shaped space therebelow;

a soil cover layer formed to cover the facility body with soil;

an elevator passage formed to extend from the cover member to a location above the soil cover layer;

an elevator car fitted into an inside of the elevator passage to be selectively lifted and lowered;

a lifting device provided in a machine room formed in an top portion of the elevator passage, connected to the elevator car, and configured to selectively lift and lower the elevator car; and a fall prevention means configured to, when an abnormality occurs in the elevator car, be operated and prevent the elevator car from falling, wherein the fall prevention means includes:

rail members provided to extend vertically inside the elevator passage;

a braking member coupled into a guide hole, formed in a circumferential surface of the elevator car, to be slidable inward or outward, and configured to, when pushed outward, be coupled with the rail members and generate frictional force;

elastic members connected to the braking member, and configured to press the braking member inward; and a pressing mechanism provided on a bracket provided in the elevator car, and configured to press the braking member outward when the elevator car is lowered at an abnormal speed;

wherein the braking member includes:

a slide block coupled into the guide hole to be slidable inward or outward, and provided with an outer surface inclined upward to an outside; and a friction member coupled to an outer surface of the slide block to be slidable in a vertical direction, and configured to come into close contact with the rail members and exert a braking force; and wherein the pressing mechanism includes:

a cam wheel coupled to the bracket to be rotatable in the vertical direction, and having a cam formed on a circumferential surface thereof;

an extension bar extending inward from the circumferential surface of the cam wheel, and having a weight at an inner end thereof;

a torsion spring provided on the cam wheel, and configured to elastically press the cam wheel so that the extension bar is rotated upward; and a ratchet rotatably coupled to the bracket, and configured to, when the cam wheel is rotated such that the extension bar is rotated upward, be caught on an inner end of the cam and perform fixation in order to prevent the cam wheel from being rotated in an opposite direction.

2. The construction structure of claim 1, wherein the cover member is constructed by bending a corrugated steel plate in an arc shape.

3. The construction structure of claim 1, wherein:

the facility body is constructed in a valley formed between mountains; and the soil cover layer is formed by covering the valley with soil.

4. The construction structure of claim 1, further comprising:

an intake pipe and an exhaust pipe extending from the cover member to a location above the soil cover layer;

an air supply fan provided in the intake pipe, and configured to supply external air to an inside of the facility body; and a dehumidification means for removing moisture contained in air sucked through the intake pipe;

wherein the dehumidifying means includes:

a cooling unit provided with an evaporator provided in a central portion of the intake pipe and a compressor and a condenser connected to the evaporator, and configured to evaporate a refrigerant, condensed by the compressor, in the evaporator so that moisture contained in air passing through the intake pipe is condensed by the evaporator and then removed;

a water collection case provided under the evaporator, and configured to collect moisture that is condensed by the evaporator and falls downward;

a water storage tank connected to the water collection case through a connection pipe, configured to store water collected in the water collection case, and provided with a drain pipe that extends out of the facility body;

a water level sensor provided in the water storage tank; and a drain pump provided on the drain pipe, and configured to receive a signal from the water level sensor and discharge the water stored in the water storage tank to the outside when the water level inside the water storage tank rises above a preset water level.

* * * * *